United States Patent [19]

Trobiani

[11] Patent Number: 4,899,413

[45] Date of Patent: Feb. 13, 1990

[54] GOLF BALL CLEANING DEVICE

[76] Inventor: Ralph A. Trobiani, 844 Grant Dr., Addison, Ill. 60101

[21] Appl. No.: 275,305

[22] Filed: Nov. 23, 1988

[51] Int. Cl.[4] ..... A63B 47/04

[52] U.S. Cl. ..... 15/21 A; 15/97 R

[58] Field of Search ..... 15/21 A, 97 R, 160, 15/210 R

[56] References Cited

U.S. PATENT DOCUMENTS

| | | | |
|---|---|---|---|
| 1,683,458 | 9/1928 | Hall | 15/21 A |
| 3,041,645 | 7/1962 | Smith | 15/21 A X |
| 3,044,089 | 7/1962 | Boynton | 15/21 A |
| 3,740,784 | 6/1973 | Morrissey | 15/21 A |
| 4,442,564 | 4/1984 | Berry | 15/21 A |

*Primary Examiner*—Edward L. Roberts

*Attorney, Agent, or Firm*—Ernest Kettelson

[57] ABSTRACT

A golf ball cleaning device comprising a small water sealable container which can be carried in a golf bag, or in a compartment thereof. The container has a peripheral dimension just enough larger than the peripheral dimension of a golf ball to have room for an upper brush to clean the upper part of the ball, a lower brush to clean the lower part of the ball, and an annular brush or scrubbing material in the form of a ring interposed between the upper and lower brush to clean the intermediate part of the ball, when the ball is positioned and held in the center of the container's cavity. The upper brush is rotatably mounted in the cover of the container with a hand crank or hand wheel to rotate the upper brush when the cover is in place on the container. Three, or more, spring fingers extend down from the base of the rotatable upper brush to hold the golf ball and position it in the center of the container's cavity when the cover is put in place to close the container. Water and a detergent or other cleaning solution is carried in the container, which is water sealeable to prevent leakage while being carried in the golfer's golf bag.

13 Claims, 5 Drawing Sheets

FIG. 2
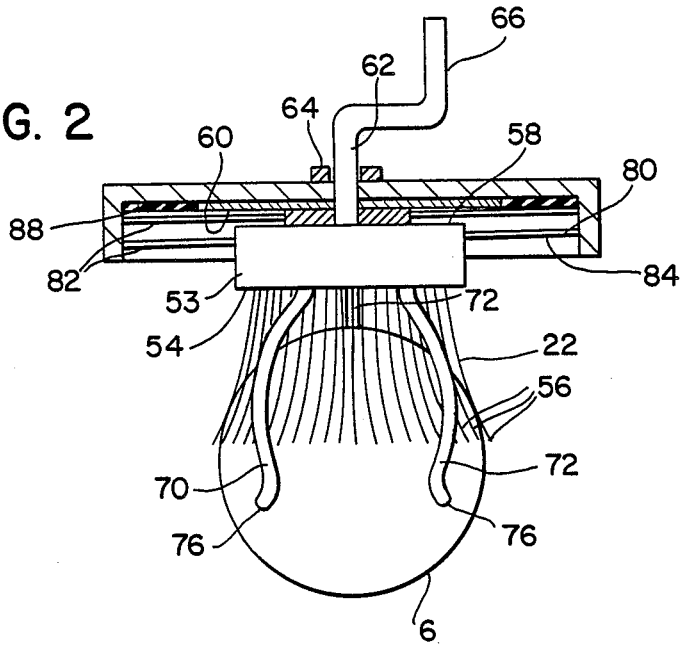
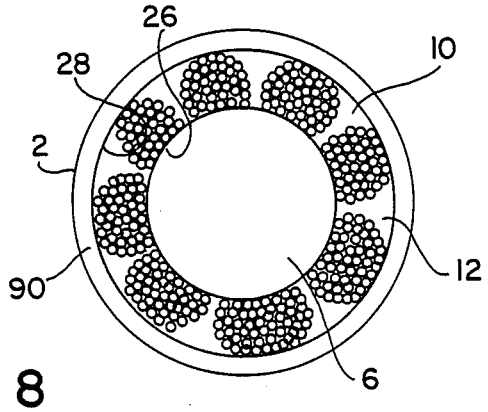
FIG. 8

GOLF BALL CLEANING DEVICE

BACKGROUND OF THE INVENTION

This invention relates to the field of devices for cleaning golf balls, and in particular to one which is water sealable and small enough to be carried in a golfer's golf bag or compartment thereof.

Examples of prior art cleaning devices for golf balls which are portable include those disclosed in the following United States patents.

U.S. Pat. No. 4,750,232 discloses a portable golf ball washer which has a single brushing component consisting of a strip of bristled carpet formed in an annular ring around the inside of a container in which the golf ball is suspended by a wire frame holder, part of which is formed as a handle for manipulating the ball held between the looped jaws of the holding device.

U.S. Pat. No. 4,210,974 discloses a portable golf ball washing device having two chambers, one to hold cleaning fluid and one to hold the golf ball for cleaning which has bristles mounted therein, and a spraying device to spray cleaning fluid from the cleaning fluid chamber on to the ball in the ball cleaning chamber.

U.S. Pat. No. 4,163,299 discloses a portable golf ball washer having a brush defining and surrounding an annular path or raceway and an impeller or drive member operated by a crank to push the golf ball around that annular path in contact with the bristles of the surrounding brush.

U.S. Pat. No. 3,981,039 discloses a portable golf ball washing device having an upper and lower circular brush, a drive member operated by a crank to push the golf ball around a circular path between the upper and lower circular brushes, and a hole in the top wall of the container to insert the ball.

U.S. Pat. No. 3,740,784 discloses a cleaning device for balls comprising a container having three brushing elements, one on top, one on the bottom and one around the side wall. The top and bottom brushes are rotatably mounted on a gear assembly for rotation by a crank extending through the top hinged lid.

U.S. Pat. No. 3,583,016 discloses another golf ball washer comprising an elongated container having brushing material around the inner surface of its peripheral wall to contact and brush a golf ball as it is reciprocated up and down by a plunger.

U.S. Pat. No. 3,271,802 discloses a golf ball cleaner which includes a container for a cleaning solution in which the golf ball may be held on a stand, and a brushing implement that may then be inserted and moved up and down to clean the sides of the golf ball.

U.S. Pat. No. 3,044,089 discloses a golf ball washer comprising a container and a two part brushing compartment therein mounted on a spring biased plunger for reciprocating up and down with a golf ball in the brushing compartment as it is dipped down into and raised up out of the water or other cleaning solution in the container which flows through the apertures of the brushing compartment.

The golf ball cleaning device in accordance with the present invention provides improvements over the prior art in that the golf ball is positioned within the container by a spring finger assembly nested within the upper brush whereby the ball rotates relative to all three cleaning components, upper, lower and middle, at the same time for simultaneous brushing and cleaning of all surface areas of the golf ball by relative movement of brushing and cleaning elements across all surface areas of the ball as long as the rotating assembly is being rotated. Such construction makes a more compact unit possible that can even be carried in a small separate compartment of a golf bag such as the one normally provided for golf balls and tees.

SUMMARY OF THE INVENTION

It is an object of this invention to provide a golf ball cleaning device which includes a container having a small peripheral dimension corresponding substantially to the size of a golf ball plus brushing or cleaning materials surrounding all surface areas of the golf ball that can fit into the ball and tee carrying compartment of a golf bag.

It is an object of this invention to provide a golf ball cleaning device which includes a small water sealable container having a cavity to receive a golf ball therein, a cover to close said container, said cavity having brushing and cleaning materials around all of its sides to simultaneously contact and brush across all surface areas of the golf ball when it is rotated within said cavity.

It is an object of this invention to provide a golf ball cleaning device which includes a small water sealable container having a cavity therein, an openable top wall, a bottom wall and a circular side wall bounding said cavity, an upper brush depending downwardly from said top wall, a lower brush projecting upwardly from said bottom wall and an annular strip of brushing and cleaning material extending inwardly from said circular side wall between said upper and lower brushes, and a spring finger assembly depending downwardly to hold a golf ball for rotation relative to said upper brush, said lower brush and said annular strip of brushing and cleaning material.

BRIEF DESCRIPTION OF THE DRAWING

FIG. 2 is a section view of the cover in accordance with this invention removed from the container to show a side elevation view of the upper brush and the spring finger retaining assembly holding a golf ball.

FIG. 8 is a top plan view of a container in accordance with this invention shown with the cover removed and a golf ball centrally positioned on the lower brush to illustrate the annular space around the golf ball in which the strip of brushing or cleaning material shown in FIG. 9 is placed when formed into an annular ring.

Figure 1:
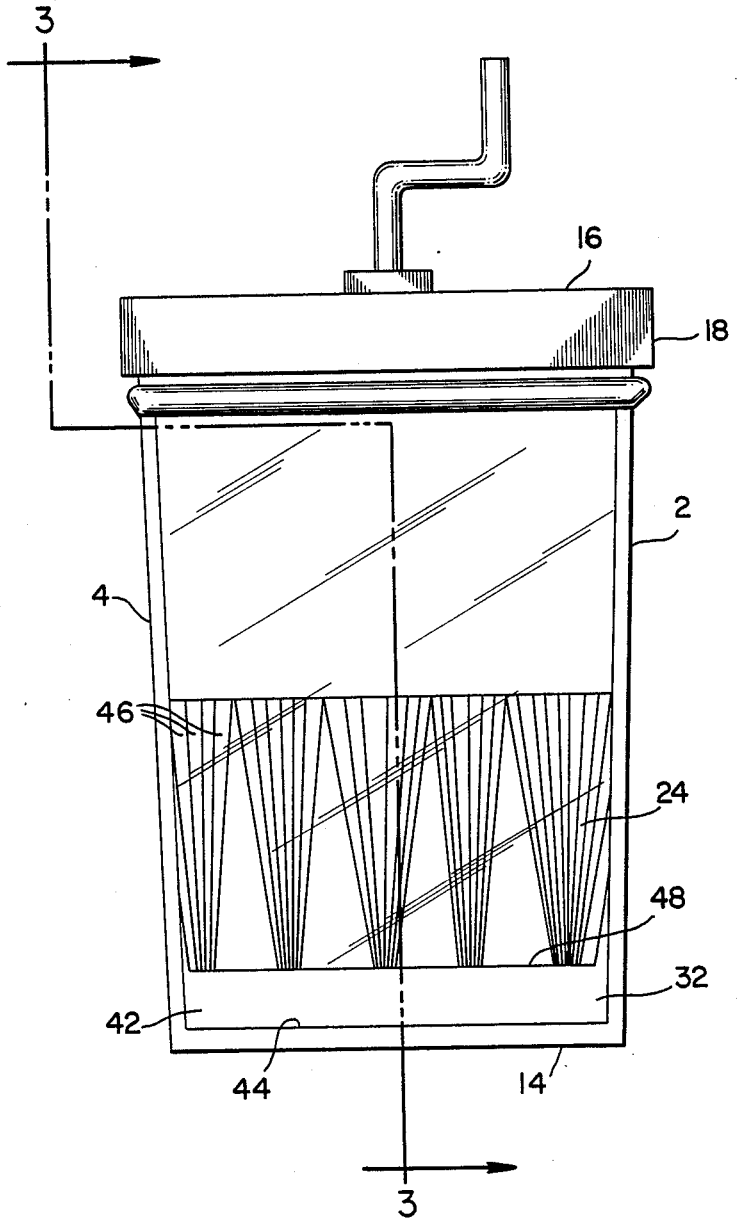
FIG. 1 is a side elevation view of a golf ball cleaning device in accordance with this invention.
Figure 3:
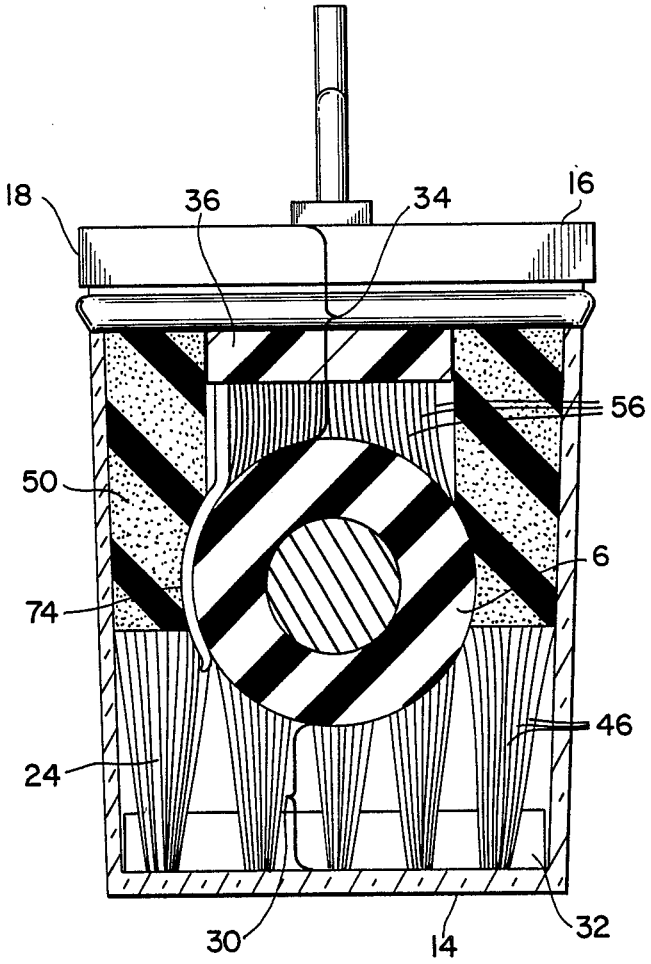
FIG. 3 is a section view taken on line 3—3 of FIG. 1.
Figure 4:
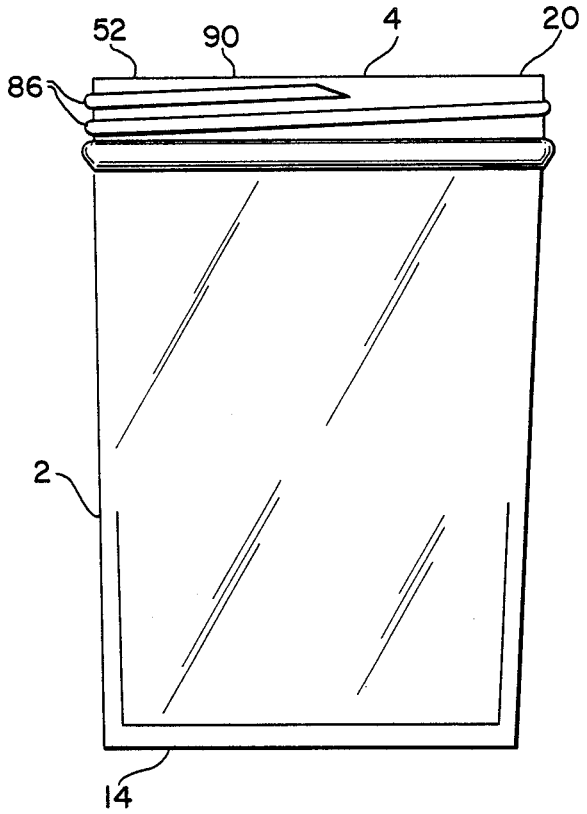
FIG. 4 is a side elevation view of the container in accordance with this invention having the cover removed.
Figure 9:
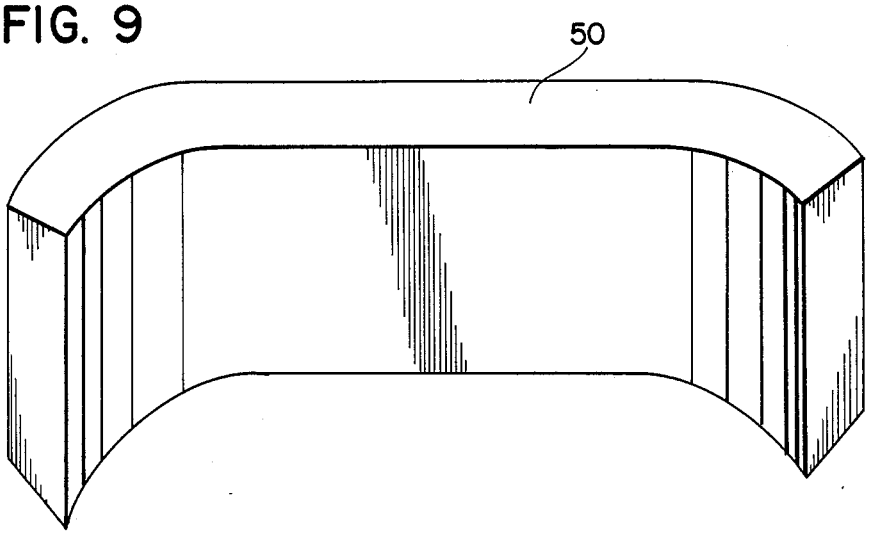
FIG. 9 is a perspective view of an elongated strip of flexible, sponge like brushing or cleaning material for seating in the annular space of the container to surround the golf ball when it is formed into an annular ring.
Figure 5:
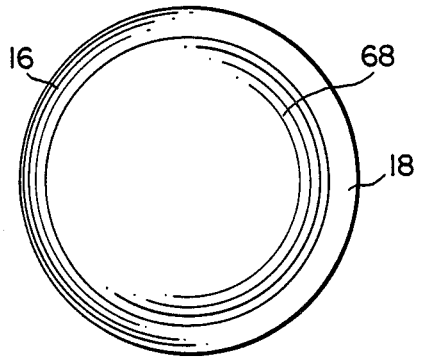
FIG. 5 is a top plan view of a modified form of this invention in which a hand wheel is provided instead of a crank to rotate the upper brush and spring finger assembly with golf ball therein.
Figure 6:
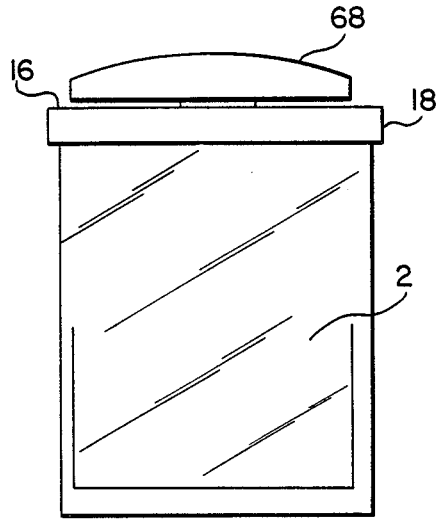
FIG. 6 is a side elevation view of the modified form of the invention shown in FIG. 5.
Figure 7:
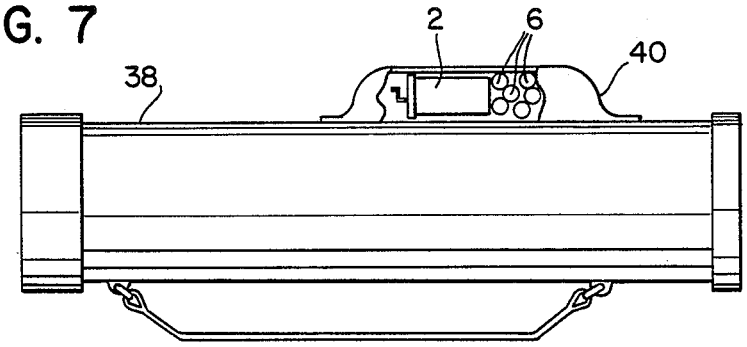
FIG. 7 is a side elevation view of a golf bag and of a compartment for holding golf balls and tees, with its side wall partly broken away to show a golf ball cleaning device in accordance with this invention received therein.

The drawings are somewhat enlarged from the actual dimensions of a golf ball and the container as well as spacings within the container for purposes of illustrating the structure of the various parts more clearly.

DESCRIPTION OF PREFERRED EMBODIMENT

A golf ball cleaning device in accordance with this invention includes a small water sealed container 2, having a cylindrical wall 4 with a diameter just enough larger than the diameter of a golf ball 6 to provide room for brushing or scrubbing materials 8 in an annular space 10 around the side of the golf ball when centered within the cylindrical cavity 12 of container 2.

The vertical dimension of the container 2 from its bottom wall 14 to the top wall 16 of its cover 18 when screwed in place over the open top wall 20 of the container 2 is just enough larger than the diameter of a golf ball 6 to provide room for an upper brush 22 and a lower brush 24 around the upper and lower portions of the golf ball when seated within the cavity 12 of container 2.

A golf ball 6 has a diameter of about one and five-eighths inches, or a radius of about thirteen sixteenths of an inch. The width across annular space 10 for the brushing or scrubbing materials, from its inner circumference 26 to its outer circumference 28 is preferably about three-eighths to a half inch. The radius of the cylindrical container 2 is therefore about one and three-sixteenths of an inch to about one and a quarter inches or a diameter of two and three-eighths inches to about two and a half inches.

A lower cylindrical space 30 is provided between the lowest portion of the golf ball 6 when seated in the cavity 12 of the container 2 and its bottom wall 14. The vertical dimension of such lower cylindrical space 30 is about three-fourths of an inch.

An upper cylindrical space 34 is provided between the uppermost portion of the golf ball 6 when seated in the cavity 12 of the container 2 and the top wall 16 of the cover 18 when in place to close the container 2. The upper cylindrical space 34 is provided for the circular base 36 of the upper brush 22. The vertical dimension of such upper cylindrical space 34 is about one and one-eighths inch.

The total vertical height of the container 2 from its bottom wall 14 to the top wall 16 of its cover 18 is therefore the sum of the following:

| | |
|---|---|
| Lower cylindrical space | = ¾ or 6/8 inch |
| Diameter of golf ball seated in the container | = 1⅝ inch |
| Upper cylindrical space | = 1⅛ inch |
| Vertical dimension of container | 3 4/8 or = 3½ inches |

The container 2 therefore has a cross-section of about two and three-eighths to about two and a half inches, and a vertical or longitudinal dimension of about three and a half inches. The cross-sectional or lateral and vertical or longitudinal dimensions of the container 2 in accordance with this invention are important to achieve the objective of being able to put it in a golf bag 38 or compartment 40 thereof.

A golfer can thus carry the sealed container 2 in his golf bag 38 and have it with him at all times while he is on the golf course. He can thereby clean his golf ball at any and all times and locations while he is golfing.

The lateral and longitudinal dimensions of the container 2 may vary from the specific dimensions disclosed and described herein, but one feature of this invention provides a golf bag compartment 40 and sealed container 2 combination in which the sealed container 2 is carried within the golf bag compartment 40 and must accordingly have a lateral or cross-sectional dimension and a longitudinal or vertical dimension that is less than the corresponding dimensions of the golf bag compartment 40.

The lower brush 24 includes the circular base 32 which has a circular peripheral wall 42 having a circumference corresponding to that of the cylindrical cavity 12 of the container 2. The circular base 32 seats snugly within the cavity 12 with the bottom wall 44 of the circular base 32 seating against the bottom wall 14 of the container 2. The snug frictional fit of peripheral wall 42 of the circular base 32 against the facing portion of cylindrical wall 4 of the container 2 holds the lower brush 24 stationary within the container 2.

A plurality of nylon bristles 46, or bristles of other comparable materials, are seated in the circular base 32 of lower brush 24 and extend upwardly from its upwardly facing wall 48. The length of bristles 46 is preferably more than one-half the diameter of a golf ball 6 and not less than one-half. Since the diameter of a golf ball 6 is about one and five-eighths inches, a convenient length of the bristles 46 of the lower brush 24 is about one inch. The objective is to provide bristles 46 which are long enough to span and brush at least the lower half of the golf ball 6 when it is seated in the cavity 12 of the container 2 wherein its lowest point is adjacent the upwardly facing wall 48 of the circular base 32.

When the golf ball 6 is placed in the container 2, it seats within the area covered by the bristles 46 and spreads them apart thereby providing good frictional brushing contact against the surface of the lower half of the ball.

The brushing or scrubbing materials 8 in annular space 10 may include a scrubbing strip 50 of compressible fabric scrubbing material formed into an annular ring and seated in the annular space 10. The vertical dimension of the scrubbing strip 50 is that which reaches from the upper circular edge 52 of the cylindrical wall 4 of container 2 downwardly to the top of the bristles 46 of the lower brush 24, which thereby spans the spherical side wall of the golf ball 6 when seated in the container 2 from its uppermost point to the point where the ball is brushed and cleaned by the bristles 46 of the lower brush 24.

The cross-sectional dimension of the compressible scrubbing strip 50, or its thickness, is greater than the width across annular space 10 from its inner circumference 26 to its outer circumference 28. It thereby presses against the surface of the golf ball 6 when it is inserted into the container 2, the ball compressing the scrubbing strip 50 around its entire surface in contact therewith for good scrubbing and cleaning action when the ball is rotated.

The upper brush 22 is rotatably mounted in the cover 18 and includes the circular base 36 which has a diameter corresponding to that of the golf ball 6, a circular peripheral wall 53, a downwardly facing surface 54, nylon bristles 56 or bristles of other comparable material seated in the base 36 and projecting from the downwardly facing surface 54, and an upwardly facing surface 58. The circular base 36 of the upper brush 22 is rotatably mounted on the inner surface 60 of the cover 18 by a drive shaft 62 extending from the center of the upwardly facing surface 58 of the circular base 36 which extends through a water sealable bearing 64 mounted in an aperture through the center of the cover 18. The upwardly facing surface 58 of the circular base 36 is slightly spaced apart from the inner surface 60 of the cover 18 to enable it to rotate freely when drive shaft 62 is rotated.

A crank 66 or hand wheel 68 is provided at the outer end of the drive shaft 82 for the user to rotate the upper brush 22.

Three arcuately spaced apart spring fingers 70, 72 and 74 are provided which have one end seated in the circular base 36 of the upper brush 22 and which extend outwardly from the downwardly facing surface 54 thereof a sufficient distance to grasp and hold the golf ball 6 therebetween. The spring fingers extend in an arcuate configuration corresponding to the curvature of the golf ball 6, and are positioned arcuately to grip the ball 6 on arcuately spaced apart sides thereof firmly enough to hold it therebetween but loosely enough to permit some rotation of the ball 6 relative to the bristles 56 which bear against and brush the upper portion of the ball when it is received between the spring fingers 70, 72 and 74.

When the cover 18 is placed on the container 2, the upper brush 22, spring fingers 70, 72 and 74 and golf ball 6 held therebetween extend down into the cylindrical cavity 12 far enough for the ball to press down into the upwardly extending bristles 46 of the lower brush 24 and spread them apart to brush against the lower surface of the ball 6. The frictional contact of the bristles 46 of the lower brush 24 provides enough frictional drag on the ball 6 when it is rotated by rotation of the drive shaft 62 and the fingers 70, 72 and 74 extending from the rotatable circular base 36, which grip the ball firmly enough to retain it but loosely enough to permit some rotation of the ball 6 relative to the bristles 56 of the upper brush 22. Such relative rotation of the ball 6 with the bristles 56 of the upper brush surrounding and bearing against the upper portion of the golf ball cleans the upper portion thereof.

The spring fingers 70, 72 and 74 extend outwardly from the downwardly facing surface 54 of the base 36 of the upper brush 22 far enough for their free ends 76 to terminate below the equatorial line 78 of the ball 6 whose upper portion is held between the spring fingers. The free ends 76 of the arcuately shaped spring fingers grip the surface of the ball 6 when held therein, and they are at such time spread outwardly against the normal inward bias of the spring fingers.

The cover 18 includes a cylindrical side wall 8 having a screw 82 formed on its inner surface 84 to threadedly engage the external screw thread 86 formed around the upper end portion of the cylindrical wall 4 of the container 2. An annular rubber seal 88 is provided around the outer circumference of the inner surface 60 of the cover 18, to seat on the annular lip 90 around the upper edge of cylindrical wall 4 of the container 2 to provide a water tight seal when the cover is screwed in place to close the container 2.

To use the golf ball cleaning device in accordance with this invention, a quantity of water is poured into the container 2 sufficient to cover the golf ball 6 when inserted into the container. A detergent may be added to the water. The cover 18 is then screwed on the top of the container with the upper brush 22 and spring fingers 70, 72 and 74 extending down into the cavity 12 of the container 2. The water is sealed within the container 2, so the container may be placed in a golf bag compartment 40 and carried along as the golfer begins playing the course.

At any time, the golfer desires to clean the golf ball, the container may be removed from the bag, the cover removed and the ball 6 inserted between the spring fingers 70, 72 and 74 by spreading them apart against their inwardly directed spring bias. The cover 18 is then screwed back on the container 2 with the upper brush 22, spring fingers 70, 72 and 74, and the ball 6 extending downwardly into the cavity 12 of the container. The ball extends downward between the bristles 46 of the circular lower brush 24, spreading them apart to frictionally bear against and brush the entire surface of the lower half of the golf ball.

The scrubbing strip 50 formed in a ring in the annular space 10 between the ball 6 and cylindrical wall 4 of the container 2 is contacted by the facing side wall portion of the golf ball in the region above and below its equatorial line, which compresses the scrubbing strip 50 thereby providing an annular scrubbing and cleaning surface around that portion of the golf ball.

The bristles 56 of the upper brush 22 are spread apart and surround the upper portion of the golf ball 6 when it is received in the spring fingers 70, 72 and 74 to clean the upper portion of the golf ball 6 as it is rotated relative to such bristles.

The golfer then uses the crank 66 or hand wheel 68 to rotate the drive shaft 62, the upper brush 22 and the ball held between the spring fingers 70, 72 and 74. The ball rotates with its lower half in contact with the bristles 46 of the lower brush 24 and its equatorial side portion in contact with the annular scrubbing strip 50 which cleans those portions. As the ball is being rotated, the frictional drag of the bristles 46 of the lower brush 24 and of the annular scrubbing strip 50 causes the ball to slip within the grasp of the spring fingers 70, 72 and 74, thereby rotating relative to the bristles 56 of the upper brush 22 which accordingly brushes and cleans the remaining upper portion of the golf ball.

The three part cleaning members which comprise the lower brush 24 to clean the lower half of the ball, the annular scrubbing strip 50 to clean the equatorial middle section of the ball and the upper brush 22 to clean the remaining upper portions of the ball make it possible to have a smaller container or enclosure than if onlY one o two brushes or cleaning devices were used. When three are used to clean three separate sections of the ball, each may be of minimum size and extend outwardly beyond the boundary of the ball itself only fractions of an inch in each direction. The result is a small enough golf ball cleaning device that it can be carried in a golf bag compartment 40.

In terms relative to the dimension of a golf ball, the vertical dimension of the container 2 with the cover 18 in place is less than two and a quarter times the diameter of a golf ball and the cross-sectional dimension of the container 2 is less than one and a half times the diameter of a golf ball.

I claim:

1. A golf ball cleaning device comprising a small container, a cavity therein to receive a golf ball for cleaning, first cleaning means positioned to clean the upper surface portion of said golf ball when received in said cavity, second cleaning means positioned to clean the lower surface portion of said golf ball when received in said cavity, a third cleaning means to clean the remaining surface portion of said golf ball between said upper and lower surface portions when received in said cavity, and ball grip rotation means to loosely grip and rotate said golf ball relative to all three of said first, second and third cleaning means when received in said cavity, and to rotate said golf ball relative to said ball grip rotation means.

2. A golf ball cleaning device as set forth in claim 1, wherein said small container has a vertical dimension less than two and one-quarter times the diameter of a said golf ball.

3. A golf ball cleaning device as set forth in claim 1, wherein said small container has a cross-sectional dimension less than one and one-half times the diameter of a golf ball.

4. A golf ball cleaning device as set forth in claim 1, wherein said small container has a vertical dimension less than two and one-quarter times the diameter of a said golf ball and a cross-sectional dimension less than one and one-half times the diameter of a golf ball.

5. A golf ball cleaning device as set forth in claim 1 and a golf bag compartment for golf balls and tees combination, wherein said small container is received in said golf bag compartment.

6. A golf ball cleaning device as set forth in claim 1, wherein said first cleaning means includes a rotary brush having a circular base, rotary brush bristles depending downwardly therefrom, said container having an open top wall, a cover to close said open top wall, said rotation means including a drive shaft extending through said cover and mounted for rotation therein having an inwardly extending end to extend into said cavity when said cover is in place to close said open top wall and an outwardly extending opposite end, said inwardly extending end of said drive shaft being connected to said circular base to rotate said rotary brush, and hand grasp means connected to said outwardly extending end of said drive shaft to manually rotate said drive shaft and said rotary brush connected thereto.

7. A golf ball cleaning device as set forth in claim 6, wherein said second cleaning means includes a circular brush having a base, circular brush bristles projecting upwardly therefrom, said container having a closed bottom wall, said base of said circular brush being seated on said closed bottom wall of said container, said upwardly projecting circular brush bristles terminating short of said downwardly depending rotary brush bristles when said cover is in place to close said open top wall of said container.

8. A golf ball cleaning device as set forth in claim 1, wherein said small container has a vertical dimension no greater than three and one-half inches and a cross-sectional dimension no greater than two and one-half inches.

9. A golf ball cleaning device as set forth in claim 1, wherein said small container includes an open top wall, a cover to close said open top wall, said cover having an aperture centrally located therethrough, a water sealable bearing in said aperture, said ball grip rotation means includes a drive shaft extending through said water sealable bearing in said aperture and mounted for rotation therein.

10. A golf ball cleaning device as set forth in claim 1, wherein said small container includes a transparent circular peripheral wall bounding said cavity, said first cleaning means comprises a member having a circular peripheral configuration, said second cleaning means comprises a member having a circular peripheral configuration, and said third cleaning means comprises a member having a circular peripheral configuration, the peripheral dimension of said members of said first, second and third cleaning means corresponding to that of said circular peripheral wall of said container.

11. A golf ball cleaning device as set forth in claim 1, wherein said first cleaning means is positioned for rotation in said container, said second cleaning means is frictionally held against rotational movement when positioned in said container, and said third cleaning means is frictionally held against rotational movement when positioned in said container, said first, second and third cleaning means being removable from said container for cleaning said container and said first, second and third cleaning means and re-insertable back into said container for use as golf ball cleaning device.

12. A golf ball cleaning device comprising a small container, a cavity therein to receive a golf ball for cleaning, first cleaning means positioned to clean the upper surface portion of said golf ball when received in said cavity, second cleaning means positioned to clean the lower surface portion of said golf ball when received in said cavity, a third cleaning means to clean the remaining surface portion of said golf ball between said upper and lower surface portions when received in said cavity, and rotation means to rotate said golf ball relative to all three of said first, second and third cleaning means when received in said cavity, wherein said first cleaning means includes a rotary brush having a circular base, rotary brush bristles depending downwardly therefrom, said container having an open top wall, a cover to close said open top wall, said rotation means including a drive shaft extending through said cover and mounted for rotation therein having an inwardly extending end to extend into said cavity when said cover is in place to close said open top wall and an outwardly extending opposite end, said inwardly extending end of said drive shaft being connected to said circular base to rotate said rotary brush, and hand grasp means connected to said outwardly extending end of said drive shaft to manually rotate said drive shaft and said rotary brush connected thereto, wherein said rotation means includes a spring finger assembly comprising a plurality of arcuately spaced apart spring fingers extending downwardly from said circular base of said rotary brush positioned to loosely grasp said golf ball for rotation thereof when said rotary brush is rotated and to permit relative rotation of said golf ball with respect to said spring fingers when said lower surface portion of said golf ball is rotated in frictional contact with said second cleaning means and when said remaining surface portion of said golf ball between said upper and lower surface portions thereof is rotated in frictional contact with said third cleaning means.

13. A golf ball cleaning device comprising a small container, a cavity therein to receive a golf ball for cleaning, first cleaning means positioned to clean the upper surface portion of said golf ball when received in said cavity, second cleaning means positioned to clean the lower surface portion of said golf ball when received in said cavity, a third cleaning means to clean the remaining surface portion of said golf ball between said upper and lower surface portions when received in said cavity, and rotation means to rotate said golf ball relative to all three of said first, second and third cleaning means when received in said cavity, wherein said first cleaning means includes a rotary brush having a circular base, rotary brush bristles depending downwardly therefrom, said container having an open top wall, a cover to close said open top wall, said rotation means including a drive shaft extending through said cover and mounted for rotation therein having an inwardly extending end to extend into said cavity when said cover is in place to close said open top wall and an outwardly extending opposite end, said inwardly extending end of said drive shaft being connected to said circular base to rotate said rotary brush, and hand grasp means connected to said outwardly extending end of said drive shaft to manually rotate said drive shaft and said rotary brush connected thereto, wherein said second cleaning means includes a circular brush having a base, circular brush bristles projecting upwardly therefrom, said container having a closed bottom wall, said base of said circular brush being seated on said closed bottom wall of said container, said upwardly projecting circular brush bristles terminating short of said downwardly depending rotary brush bristles when said cover is in place to close said open top wall of said container, wherein said container includes a peripheral said wall having an inner surface bounding said cavity, said third cleaning means includes an elongated strip of compressible cleaning material extending around said inner surface of said peripheral wall and spanning the distance between said downwardly depending rotary brush bristles and said upwardly projecting circular brush bristles.

* * * * *